US005607146A

United States Patent [19]

Novick et al.

[11] Patent Number: 5,607,146

[45] Date of Patent: Mar. 4, 1997

[54] MECHANISM FOR DIVERTING OF PRODUCTS IN A FOLDING APPARATUS

[75] Inventors: Michael A. Novick, New Durham; Roger R. Belanger, Dover, both of N.H.

[73] Assignees: Heidelberger Druckmaschinen AG, Heidelberg, Germany; Heidelberg Harris, Inc., Dover, N.H.

[21] Appl. No.: 602,670

[22] Filed: Feb. 16, 1996

[51] Int. Cl.[6] ..... B41L 43/08

[52] U.S. Cl. ..... 270/42; 271/279; 271/302

[58] Field of Search ..... 270/41, 42, 43, 270/47; 271/279, 287, 300, 302, 69

[56] References Cited

U.S. PATENT DOCUMENTS

| | | | |
|---|---|---|---|
| 4,373,713 | 2/1983 | Loebach | 271/302 X |
| 4,534,552 | 8/1985 | Rahe | 271/302 X |
| 4,607,341 | 8/1986 | Monchalin . | |
| 4,729,282 | 3/1988 | Kasdorf | 271/302 X |
| 4,729,298 | 3/1988 | Dörnemann . | |
| 4,948,112 | 8/1990 | Sato et al. . | |
| 5,112,033 | 5/1992 | Breton | 270/47 |

*Primary Examiner*—Hoang Nguyen
*Attorney, Agent, or Firm*—Kenyon & Kenyon

[57] ABSTRACT

A device for diverting signatures into pockets of at least two slow-down devices is provided. The device includes a set of high-speed tapes (3) arranged downstream of a pair of cutting cylinders (2). A set of diverting belts (6) comprises raised surface portions (6.3) and non-raised surface portions (6.4). The set of high-speed tapes (3) is assigned to the diverting belts (6) to ride on the raised and non-raised surface portions (6.3, 6.4) thereof, thus, periodically altering a signature conveying path (1) of signatures.

21 Claims, 3 Drawing Sheets

MECHANISM FOR DIVERTING OF PRODUCTS IN A FOLDING APPARATUS

FIELD OF THE INVENTION

The present invention relates to a mechanism for diverting products in a folding apparatus.

BACKGROUND INFORMATION

U.S. Pat. No. 4,948,112 purports to disclose a folding machine in a rotary press. In the folding machine a printed web of paper is cut into sheets which are then folded. The folded signatures are conveyed through a distributor section on the downstream side of the machine to a pair of ejected papersheet runners. A conveyor for conveying the folded sheets includes a pair of first conveyor belts between the outlet side of the cutter drums and the upstream side of the distributor section, a pair of distributor belts forming the distributor section, with a triangular guide disposed on the downstream side thereof. The conveyor further includes two pairs of second conveyor belts between the downstream side of the distributor section and the inlet sides of the pair of ejected paper sheet runners, and guide belts or fixed guide members extending between a location upstream of the distributor section and the inlet side of the distributor section and between the outlet side of the distributor section and a location downstream of the distributor section. These belt pairs define, respectively, independent closed routes. The pair of distributor belts are respectively provided with uneven portions along their lengths adapted to mesh with each other. Preferably, the pair of distributor belts run at a higher speed than the pair of first conveyor belts and the two pairs of second conveyor belts run at a higher speed than the pair of distributor belts.

SUMMARY OF THE INVENTION

The above-described device according to U.S. Pat. No. 4,948,112 has several disadvantages. For example, the high speed tapes in this device spread apart and release the signatures well above the guide member in order to allow the signature to be transferred to the distributor belts. In addition, this device requires control of the signatures to be transferred twice: once when the signature is transferred from the high speed tapes to the distributor belts; and then again when the signature is transferred from the distributer belts back to the high speed tapes. Each transfer of control from one belt to the other risks damage to the signature. Moreover, since the uneven portions of the distributor belts directly contact the signature's surfaces, they must be constructed to avoid marking the surface of the signatures.

In accordance with the present invention, a device for diverting signatures into pockets of at least two slow-down devices is provided. A first high speed tape and a second high speed tape, each having respective inner and outer surfaces, are located downstream of a pair of cutting cylinders and upstream of a guide member. The outer surfaces of the first and second high speed tapes engage each other at a diverting nip. The inner surface of the first high speed tape is engaged with a first diverting belt having raised and non-raised surface portions. The inner surface of the second high speed tape is engaged with a second diverting belt having raised and non-raised surface portions. The first diverting belt is arranged in phase opposition to the second diverting belt such that the raised portion of the first diverting belt coincides with the non-raised portion of the second diverting belt at the diverting nip between the first and second high speed tapes, and vice versa. Therefore, as the first and second diverting belts move through the nip, the conveying path of signatures traveling between the first and second high speed tapes is altered towards one side or the other of the guide member. The first and second high speed tapes and the first and second diverting belts may be driven in any known manner. Moreover, they can be driven independently, or through a common drive. In addition, the first and second high speed tapes may include respective first and second sets of high speed tapes. Similarly, the first and second diverting belts may include respective first and second sets of diverting belts.

In accordance with a first embodiment of the present invention, each diverting belt is integrated into a closed loop path of its respective high speed tape. As a result, the signatures remain in constant contact with the high speed tapes as they are diverted to one side or the other of the guide member. In contrast to U.S. Pat. No. 4,948,112, this design provides the advantage of eliminating the transition areas between upper transporting tapes and lower transporting tapes, and, thus, decreases the number of signature-contacting surfaces. Moreover, no special treatment of the raised and non-raised surfaces of the diverting belts is necessary because the raised and non-raised surface portions do not contact the signatures. In addition, by integrating the diverting belts into the path of their respective high speed tapes, the signature conveying path, rather than the signature, is periodically moved between two vertically extending conveying paths. Further, since the diverting belts are integrated into paths of their respective high speed tapes, a compact design is realized.

In accordance with a second embodiment of the present invention, each of the first and second diverting belts includes transition sections between their raised and non-raised portions. The transition sections gradually extend from the raised portions to the non-raised portions, thus causing a gradual change of the position of the vertical conveying plane of the signatures traveling between the high speed tapes.

In accordance with a third embodiment of the present invention, the guide member extends into the paths of the diverting belts and their respective high speed tapes and defines an entry region having a first entry branch and a second entry branch, respectively, for directing the signatures into pockets of different fan wheels or other slow-down devices.

In accordance with a fourth embodiment of the present invention, the guide member is mounted on a diverting unit which includes a first transport tape and a second transport tape, each extending in a substantially vertical direction. The first and second transport tapes cooperate, respectively, with the first high-speed tapes and second high-speed tapes to transport the signatures towards respective fan wheels. Thus, the signatures, having passed the first or second branch of the entry region, are conveyed directly into fan pockets of the fan wheels, the envelope curves of which pass below the diverting unit.

The present invention further provides greater flexibility in spacing the high-speed tapes. For example, since the first and second diverting belts are integrated within the path of the first and second high speed belts, rather than adjacent to the path of the high speed belts, the high speed belts can be spaced more closely together than the belts of U.S. Pat. No. 4,948,112.

DETAILED DESCRIPTION OF THE INVENTION

Figure 1:
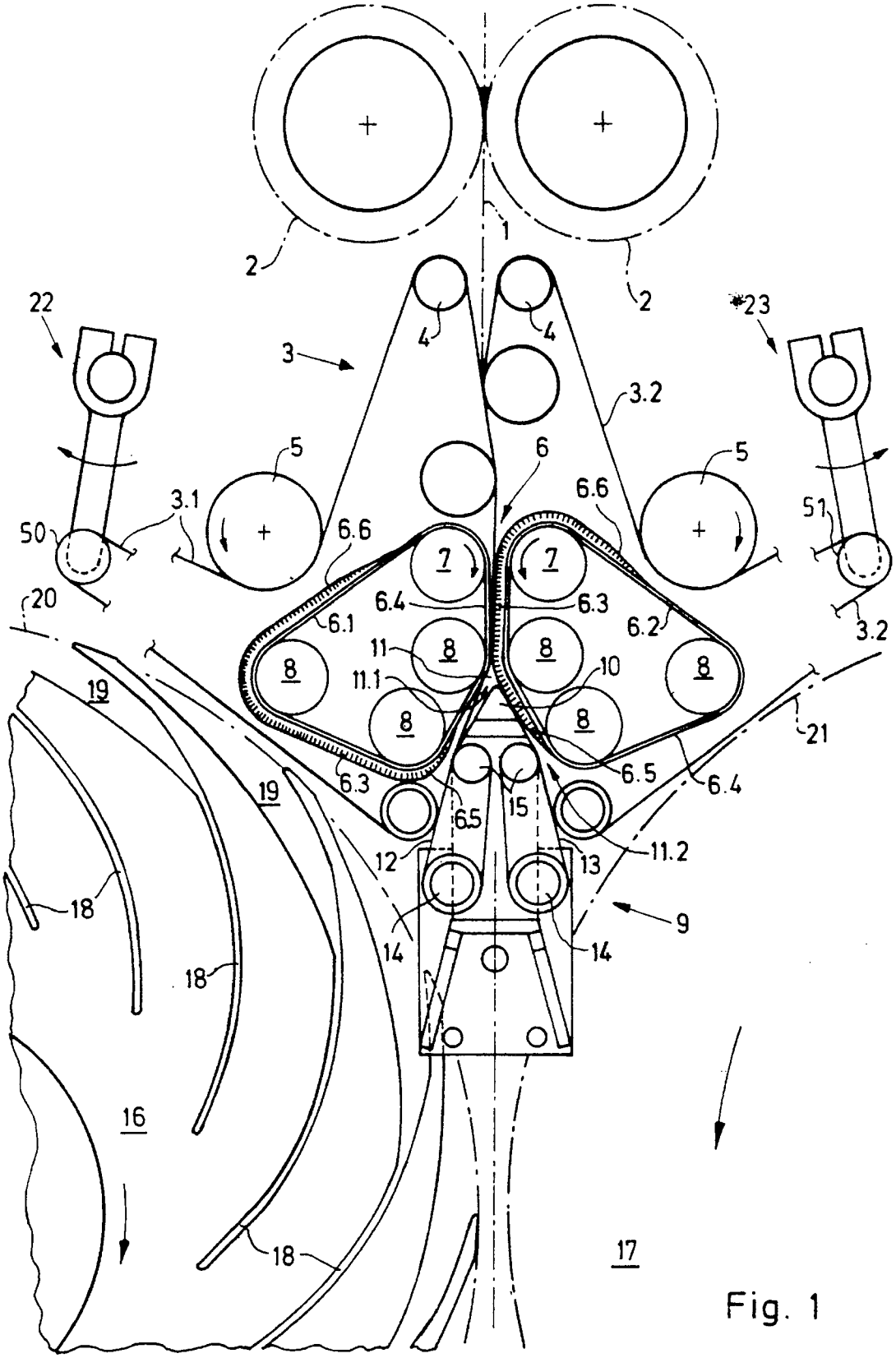
FIG. 1 shows an apparatus according to an embodiment of the present invention including first and second diverting belts integrated into the path of first and second high-speed tapes and arranged above a diverting unit.
Figure 2:
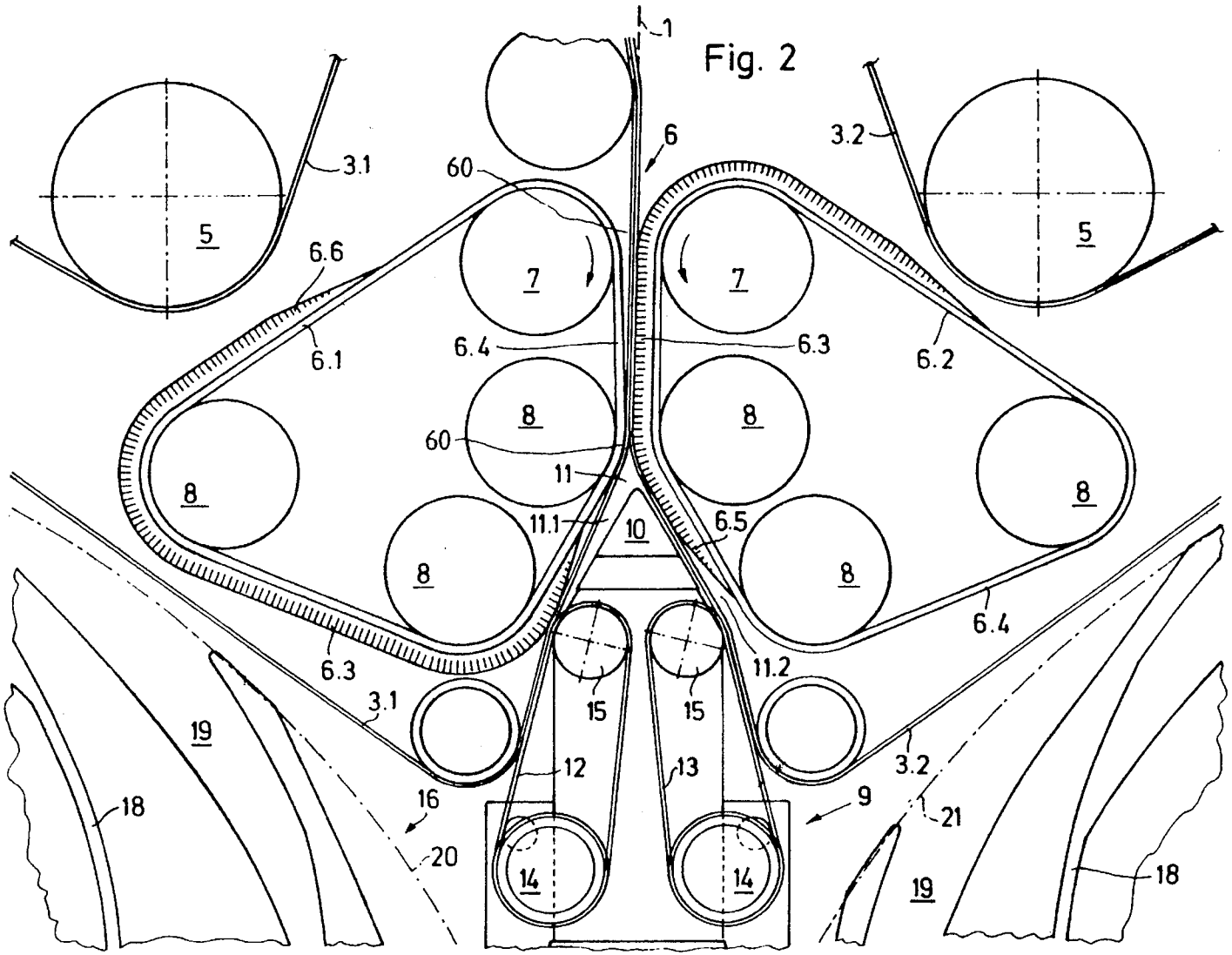
FIG. 2 shows the diverting belts, the high-speed tapes, and the diverting unit of FIG. 1 in more detail.
Figure 3:
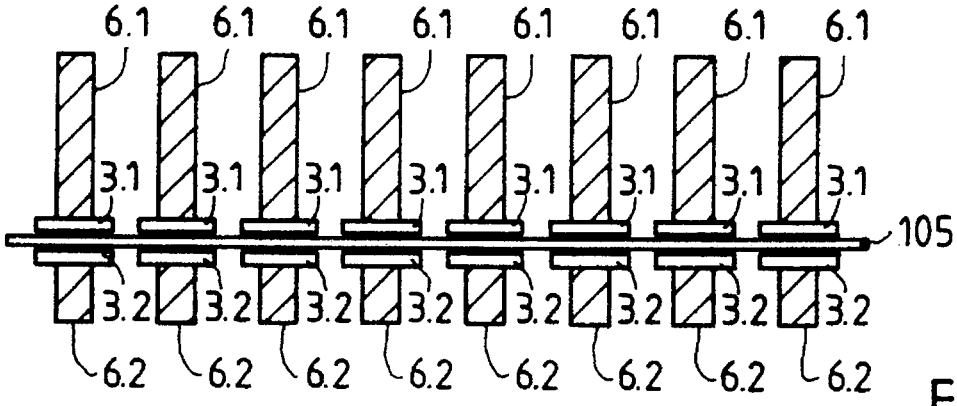
FIG. 3 shows the integration of the diverting belts and the high-speed tapes in accordance with the present invention.

FIG. 1 shows a signature conveying path 1 for signatures after they have been cut between a pair of cutting cylinders 2. A set of high-speed tapes 3 is arranged below the pair of cutting cylinders 2. Referring to FIGS. 1–3, the set of high-speed tapes 3 includes first high-speed tapes 3.1 and second high-speed tapes 3.2. The high-speed tapes 3.1 and 3.2 are wound around respective driven rollers 4 and driving rollers 5. In addition, high speed tapes 3.1, 3.2 are wound around driven rollers 50, 51, which, in turn, are rotatably mounted on respective tensioning devices 22, 23. The driving rollers 5 may be driven in any conventional manner. The high-speed tapes 3.1 and 3.2 each traverse closed paths, and the tension of the tapes 3.1, 3.2 can be adjusted by tensioning devices 22, 23, respectively.

Integrated into the closed paths of the high-speed tapes 3.1 and 3.2 is a set of diverting belts 6. The diverting belts 6 include first diverting belts 6.1 and second diverting belts 6.2. The diverting belts 6.1 and 6.2 are driven by driving rollers 7 and wound around further driven rollers 8. The driving rollers 7 may be driven from the same drive as rollers 5, or may be driven independently. In the lower region of the set of diverting belts 6, the rollers 8 are arranged to form an opening into which a guide member 10 is positioned. The guide member 10 may be of any conventional design to suit the present invention.

Referring to FIG. 2, the first diverting belts 6.1 and the second diverting belts 6.2 are integrated into the closed loop paths of the high-speed tapes 3.1 and 3.2 in such a way that the high-speed tapes 3.1 and 3.2 engage the diverting belts 6.1 and 6.2 at a diverting nip 60 of the conveying path 1. The diverting belts 6.1 and 6.2 each include a raised surface portion 6.3 and a non-raised surface portion 6.4. The raised portion 6.3 on each of the diverting belts 6.1 and 6.2 includes respective transition sections 6.5 and 6.6 allowing for a smooth transition between the raised and non-raised surface portions 6.3 and 6.4, respectively. The raised and the non-raised surface portions of the first diverting belts 6.1 are in phase opposition to the raised and non-raised portions of the second diverting belts 6.2.

Therefore, as shown in the accompanying drawings, when the non-raised surface portion 6.4 of the first diverting belt 6.1 and the raised portion 6.3 of the second diverting belt 6.2 travel through the diverting nip 60, the high-speed tapes 3.1 and 3.2 are diverted to the left side of the guide member 10. Accordingly, signatures being conveyed downstream between the high speed tapes 3.1, 3.2 will enter a first entry branch 11.1. Similarly, when the non-raised surface portion 6.4 of the second diverting belt 6.2 and the raised portion 6.3 of the first diverting belt 6.1 travel through the diverting nip 60, the high-speed tapes 3.1 and 3.2 are diverted to the fight side of the guide member 10. Consequently, signatures being conveyed downstream between the high speed tapes 3.1, 3.2 will enter a second entry branch 11.2.

In this manner, the raised and non-raised surface portions 6.3 and 6.4 cooperate to alter the vertical orientation of the signature conveying path 1 prior to diverting the signature to the first entry branch 11.1 or the second entry branch 11.2 of the guide member 10. The transition sections 6.5 and 6.6 of the diverting belts 6.1 and 6.2 allow for smooth lateral movement of the vertically extending conveying plane. In addition, since the diverting belts 6.1 and 6.2 are integrated into the conveying paths of, and engaged with, the high-speed tapes 3.1 and 3.2, respectively, the signatures being conveyed downstream will not be contacted by the diverting belts.

In accordance with the embodiment of FIGS. 1 and 2, upon common movement of the set of diverting belts 6 with the set of high-speed tapes 3, every other signature is delivered to one or the other side of the guide member 10. However, by judiciously altering the size of the diverting belts 6.1, 6.2 the length of the respective raised and unraised portions 6.3, 6.4, and/or the number of the respective raised and unraised portions 6.3, 6.4, the device according to the present invention can provide other diverting patterns; e.g., diverting every third or fourth signature to one side or the other of the guide member, or diverting alternating pairs of signatures to one or the other side of the guide member 10.

After the signatures reach their respective entry branches 11.1 or 11.2, the signatures are conveyed either by the first high-speed tapes 3.1 and a first transport tape(s) 12, or by the second high-speed tapes 3.2 and a second transport tape(s) 13. After the first high-speed tapes 3.1 and the second high-speed tapes 3.2 have passed the entry branches 11.1 and 11.2, they are no longer engaged with the set of diverting belts 6.1 and 6.2, respectively.

As can be seen in the accompanying drawings, the signatures leaving the first entry branch 11.1 are conveyed to a fan blade entry region 19 defined in fan pockets 18 of a left fan wheel 16. Similarly, the signatures leaving the second entry branch 11.2 are conveyed to a fan blade entry region 19 defined in fan pockets 18 of a right fan wheel 17. The phasing between the high-speed tapes 3.1 and 3.2 and diverting belts 6.1 and 6.2 allows the signatures to be safely inserted into fan pockets 18 of the fan wheels 16, 17, respectively.

Furthermore, in accordance with a further embodiment of the present invention, the first and second secondary transport tapes 12 and 13 are mounted within a diverting unit 9.

Since the raised and non-raised surface portions 6.3 and 6.4 do not directly contact the surfaces of the signatures to be diverted, a special surface treatment of the portions 6.3 and 6.4 is not required. Therefore, the raised surface portions 6.3 may be formed, for example, of an elastic layer made of, for example polyurethane, a multi-layered material such as a cloth and polyurethane laminate, or even fabrics. Since the high-speed tapes 3.1 and 3.2, respectively, are pretensioned, the raised surfaces 6.3 may be compressed to a certain extent. This compression is preferably taken into account when determining the thicknesses of the raised portions 6.3 and the diverting belts 6.1 and 6.2, respectively. The amount of lateral movement of the vertically extending conveying path 1 above the guide member 10 can be predetermined by the thickness of the raised surface portion 6.3 of the set of diverting belts 6.

In addition, since the diverting belts 6.1 and 6.2 are integrated with high-speed tapes 3.1 and 3.2 respectively, the present invention provides greater flexibility in spacing the high-speed tapes 3.1 and 3.2 than prior art systems. For example, in the prior art system illustrated in FIG. 4, distributor belts 103 and 104 are not integrated with high-speed tapes 101 and 102. Instead, the distributor belts 103, 104 are arranged adjacent to the high speed tapes 101, 102. As a result, the present invention allows the high speed tapes 3.1 and 3.2 to be spaced much closer together than prior art systems. This allows more high speed tapes 3.1, 3.2 to be arranged across the width of the signature 105, thereby providing more control over the signature as it passes through the diverting nip 60. In addition, since the present invention allows greater flexibility in the spacing of the tapes 3.1, 3.2, the open edges 106 of the signature 105 can be more closely aligned with the high speed tapes than in the prior art system of FIG. 4. This, in turn, reduces the likelihood of tears or dog-ears forming on the open edges 106.

Figure 4:
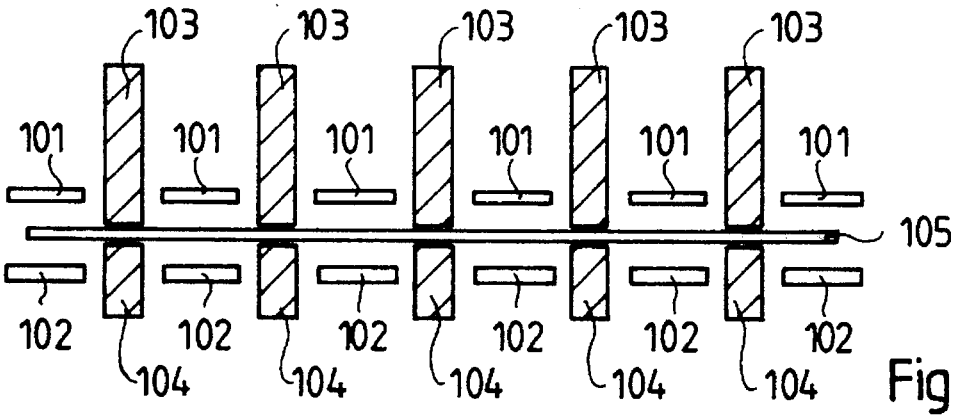
Fig. 4 Prior Art
FIG. 4 shows a prior art arrangement of distributor belts and high-speed tapes.

Moreover, since the diverting belts 6.1 and 6.2 are integrated with the high-speed tapes 3.1 and 3.2, respectively, the signature remains under the control of the high-speed tapes 3.1 and 3.2 as it passes through the diverting nip. In contrast, as illustrated in FIG. 4, in prior art systems, control of the signature 105 is transferred from the tapes 101,102 to the diverting belts 103, 104.

What is claimed is:

1. A device for diverting a signature, comprising:

a first high-speed tape having an inner surface and an outer surface and a second high-speed tape having an inner surface and an outer surface, the outer surface of the first high speed tape engaging the outer surface of the second high speed tape at a diverting nip;

a first diverting belt having raised surface portions and non-raised surface portions;

a second diverting belt having raised surface portions and non-raised surface portions, the inner surface of the first high-speed tape engaging the first diverting belt at the diverting nip and the inner surface of the second high-speed tape engaging the second diverting belt at the diverting nip; and a drive for rotating the first and second high speed tapes and the first and second diverting belts, the raised and the non-raised surface portions of the first and second diverting belts periodically altering a conveying path of a signature conveyed between the first and second high speed tapes.

2. The device according to claim 1, wherein the first and second diverting belts include respective first and second sets of diverting belts, and wherein the first and second high speed tapes include respective first and second sets of high speed tapes.

3. The device according to claim 1, wherein the first and second diverting belts further include transition sections between their respective raised and the non-raised surface portions.

4. The device according to claim 3, wherein the transition sections gradually extend from the raised portions to the non-raised portions.

5. The device according to claim 1, further comprising a guide member positioned downstream of the diverting nip, an entry region being defined between the first and second high-speed tapes and the guide member.

6. The device according to claim 5, wherein the entry region has a first entry branch and a second entry branch defined between the first high-speed tape and the guide member and the second high-speed tape and the guide member, respectively.

7. The device according to claim 1, wherein the first and second diverting belts travel along respective closed loops.

8. The device according to claim 1, wherein the first and second high speed tapes travel along respective closed loops.

9. The device according to claim 5, wherein the guide member further includes a diverting unit, the diverting unit having a first transport tape and a second transport tape.

10. The device according to claim 9, wherein the first and second transport tapes substantially extend in a vertical direction.

11. The device according to claim 9, wherein the first transport tape cooperates with the first high-speed tape after the first entry branch.

12. The device according to claim 9, wherein the first transport tape cooperates with the first high-speed tape to convey the signatures into fan pockets of a first fan wheel.

13. The device according to claim 11, wherein the second transport tape cooperates with the second high-speed tape after the second entry branch.

14. The device according to claim 12, wherein the second transport tape cooperates with the second high-speed tape to convey the signatures into fan pockets of a second fan wheel.

15. The device according to claim 1, further comprising:

a pair of cutting cylinders arranged upstream of the first and second high speed belts;

a guide member arranged downstream of the diverting nip; and a first fan wheel and a second fan wheel arranged downstream of the guide member.

16. The device according to claim 1, wherein the raised and non raised portions of the first diverting belt are in phase opposition to the raised and non-raised portions of the second diverting belt.

17. The device according to claim 1, wherein the drive includes a first drive for driving the first and second high speed tapes and a second drive for driving the first and second diverting belts.

18. The device according to claim 1, wherein the drive includes a first drive for driving the first and second high speed tapes and the first and second diverting belts.

19. A device for diverting a signature towards one of at least two slow down devices, comprising:

a first high-speed tape and a second high-speed tape located downstream of a pair of cutting cylinder, the first high speed tape engaging the second high speed tape at a diverting nip;

a first diverting belt having raised surface portions and non-raised surface portions;

a second diverting belt having raised surface portions and non-raised surface portions, the first high-speed tape engaging the first diverting belt at the diverting nip and the second high-speed tape engaging the second diverting belt at the diverting nip;

a guide member located downstream of the first and second diverting belts, a first entry branch and a second entry branch being defined between the guide member and the first and second diverting belts, respectively;

a drive for rotating the first and second high speed tapes, and the first and second diverting belts, the raised and the non-raised surface portions of the first and second diverting belts alternately diverting signatures towards into the first and second entry regions;

a first slow down device receiving signatures from the first entry branch; and a second slow down device receiving signatures from the second entry branch.

20. The device according to claim 19, wherein the first and second slow down devices comprise first and second fan wheels.

21. A device for diverting a signature towards one of at least two slow down devices, comprising:

a first high-speed tape and a second high-speed tape, the first high speed tape engaging the second high speed tape at a diverting nip;

a first diverting belt having raised surface portions and non-raised surface portions;

a second diverting belt having raised surface portions and non-raised surface portions, the first high-speed tape engaging the first diverting belt at the diverting nip and the second high-speed tape engaging the second diverting belt at the diverting nip, the raised and the non-raised surface portions of the first and second diverting belts periodically altering a conveying path of a signature conveyed between the first and second high speed tapes.

* * * * *